US007222815B2

(12) United States Patent
Chen

(10) Patent No.: US 7,222,815 B2
(45) Date of Patent: May 29, 2007

(54) DOFFING APPARATUS OF A HIGH-SPEED HIGH-STAND FABRIC TAKE-UP DEVICE

(75) Inventor: Shih-Chi Chen, Taipei Hsien (TW)

(73) Assignee: Pai Lung Machinery Mill Co., Ltd., Jui-Fang Town, Taipei Hsien (TW)

( * ) Notice: Subject to any disclaimer, the term of this patent is extended or adjusted under 35 U.S.C. 154(b) by 173 days.

(21) Appl. No.: 11/143,436

(22) Filed: Jun. 3, 2005

(65) Prior Publication Data

US 2006/0273215 A1 Dec. 7, 2006

(51) Int. Cl.
*B65H 19/22* (2006.01)

(52) U.S. Cl. ..... 242/533.2; 242/598.3

(58) Field of Classification Search ..... 242/598, 242/598.3, 599.3, 599.4, 533, 539, 533.2, 242/473.5; 66/149 R, 149 S, 150–153; 139/304–316
See application file for complete search history.

(56) References Cited

U.S. PATENT DOCUMENTS 5,211,036 A * 5/1993 Engelfried et al. ..... 66/151
6,016,987 A * 1/2000 Kohnen ..... 242/533.2
6,276,630 B1 * 8/2001 Mueller et al. ..... 242/598.3
6,637,241 B1 * 10/2003 Wang ..... 66/151
7,093,466 B1 * 8/2006 Chen ..... 66/153

* cited by examiner

*Primary Examiner*—Patrick Mackey
*Assistant Examiner*—William E. Dondero
(74) *Attorney, Agent, or Firm*—Birch, Stewart, Kolasch & Birch, LLP

(57) ABSTRACT

The present invention discloses a doffing apparatus of a high-speed high-stand fabric take-up device, which is applicable to a fabric take-up device having a higher fabric-storage volume. The doffing apparatus has safety pins and control handles in the side-frame casings of the fabric take-up device. Via shifting the control handles to change the relative positions of the safety pins, the safety pins can be inserted into the rod shafts of the fabric-winding rod so that the coupling between the drive wheels and the rod shafts can be enhanced and the safety of a fabric-winding operation can be promoted. Further, hydraulic cylinders are installed between the side-frame casings of the fabric take-up device and the support brackets sustaining the fabric-winding rod. Via the hydraulic cylinders providing a buffer force for the support brackets, the support brackets can rotate and descend slowly, and the safety of a fabric-doffing operation can be promoted.

4 Claims, 6 Drawing Sheets

DOFFING APPARATUS OF A HIGH-SPEED HIGH-STAND FABRIC TAKE-UP DEVICE

FIELD OF THE INVENTION

The present invention relates to a doffing apparatus of a fabric take-up device, particularly to a doffing apparatus of a high-speed high-stand fabric take-up device, which can promote the safety of fabric-winding and fabric-doffing operations.

BACKGROUND OF THE INVENTION

At present, the fabric completed by a knitting machine is wound up into a roll by a fabric take-up device. However, the roll of fabric wound up by a small-size fabric take-up device has a diameter of only about 20 inches, and owing to its small fabric-storage volume, it is gradually obsolete. In order to meet the demand for higher fabric-storage volume, the industry has developed a high-speed high-stand fabric take-up device; as the roll of fabric wound up thereby can reach a diameter up to about 46 inches, it has been widely applied in the industry.

A general high-speed high-stand fabric take-up device is usually formed of two side-frame casings sitting opposite to each other, a fabric-conveying apparatus, a fabric-winding apparatus used for taking up fabric, and a fabric-doffing apparatus used for unloading fabric. The fabric-conveying apparatus is primarily composed of several rollers, which are pivotedly installed above two side-frame casings and convey fabric to the fabric-winding apparatus. The fabric-winding apparatus is primarily composed of two drive wheels and a fabric-winding rod, wherein two drive wheels are separately installed on the middle portions of two side-frame casings, and one face of the drive wheel has a rabbet extending to the perimeter of the drive wheel. Each end of the fabric-winding rod protrudes a rod shaft. The fabric-winding rod is coupled to the drive wheels via engaging the rod shafts into the rabbets, and the drive wheels can drive the fabric-winding rod to rotate in order to undertake a fabric take-up operation. The fabric-doffing apparatus is primarily formed of a rod and two support brackets, wherein the rod is pivotedly installed between the portions near the bottoms of the side-frame casings; one end of each support bracket is coupled to the rod, and the other end of each support bracket is used to support the fabric-winding rod to span between two support brackets; via the rotation of the rod, the support brackets bring the fabric-winding rod to descend.

However, the conventional high-speed high-stand fabric take-up device has the following disadvantages:

1. As the rod shaft of the fabric-winding rod is coupled to the drive wheels via engaging the rod shafts into the rabbets of the drive wheels, the coupling effect is inferior, and it is probable for the fabric-winding rod to decouple from the drive wheels when the rotation speed of the fabric rod increases.
2. Currently, the fabric-doffing operation is performed by man. As the weight of the fabric on the fabric-winding rod is appreciable now, it is a probable danger that operators be contused by a fast-descending fabric roll. Therefore, a lifter is usually used to unload fabric rolls. The lifter can solve the problem of personnel contusion; however, it has an appreciable volume, and a special aisle needs reserving for the lifter, which will decrease the number of the fabric take-up devices installed inside the factory and reduce the overall productivity.

SUMMARY OF THE INVENTION

The objective of the present invention is to provide a doffing apparatus of a fabric take-up device, wherein not only the safety of fabric-winding operation can be promoted via enhancing the connection between the drive wheels and the fabric-winding rods, but also the safety of fabric-doffing operation can be promoted via decelerating the rotation speed of the support brackets that sustain the fabric-winding rod.

To achieve the aforementioned objective, the doffing apparatus of a fabric take-up device of the present invention comprises: a couple of control handles, a couple of safety pins, a rod, a couple of support brackets, and a couple of hydraulic cylinders. The couple of control handles are separately installed on two side-frame casings sitting opposite to each other. Each control handle has a fixed end and a movable end. The fixed end is fixed to the interior of the side-frame casing, and the movable end projects through an opening of the side-frame casing to the exterior of the side-frame casing. Each safety pin penetrates the corresponding drive wheel. One end of the safety pin is fixed to the control handle, and the connection and disconnection between the other end of the safety pin and the rod shaft of the fabric-winding rod can be implemented via shifting the movable end of the control handle. The rod is pivotedly installed between two side-frame casings. One end of support bracket is fixed to the rod, and the other end of the support bracket has a longitudinal notch, which is used to support the fabric-winding rod to span between two support brackets. The couple of hydraulic cylinders are separately disposed in two side-frame casings. One end of the hydraulic cylinder is pivotedly installed to the side-frame casing, and the other end of the hydraulic cylinder has a cylinder shaft, which can move back and forth along the hydraulic cylinder, and the external end of the cylinder shaft is pivotedly installed to the support bracket. The hydraulic cylinders can provide a buffer force to decelerate the rotation of the support bracket.

The preferred embodiments and the technical contents of the present invention are to be described below in cooperation with the attached drawings.

DETAILED DESCRIPTION OF THE PREFERRED EMBODIMENTS

Figure 1:
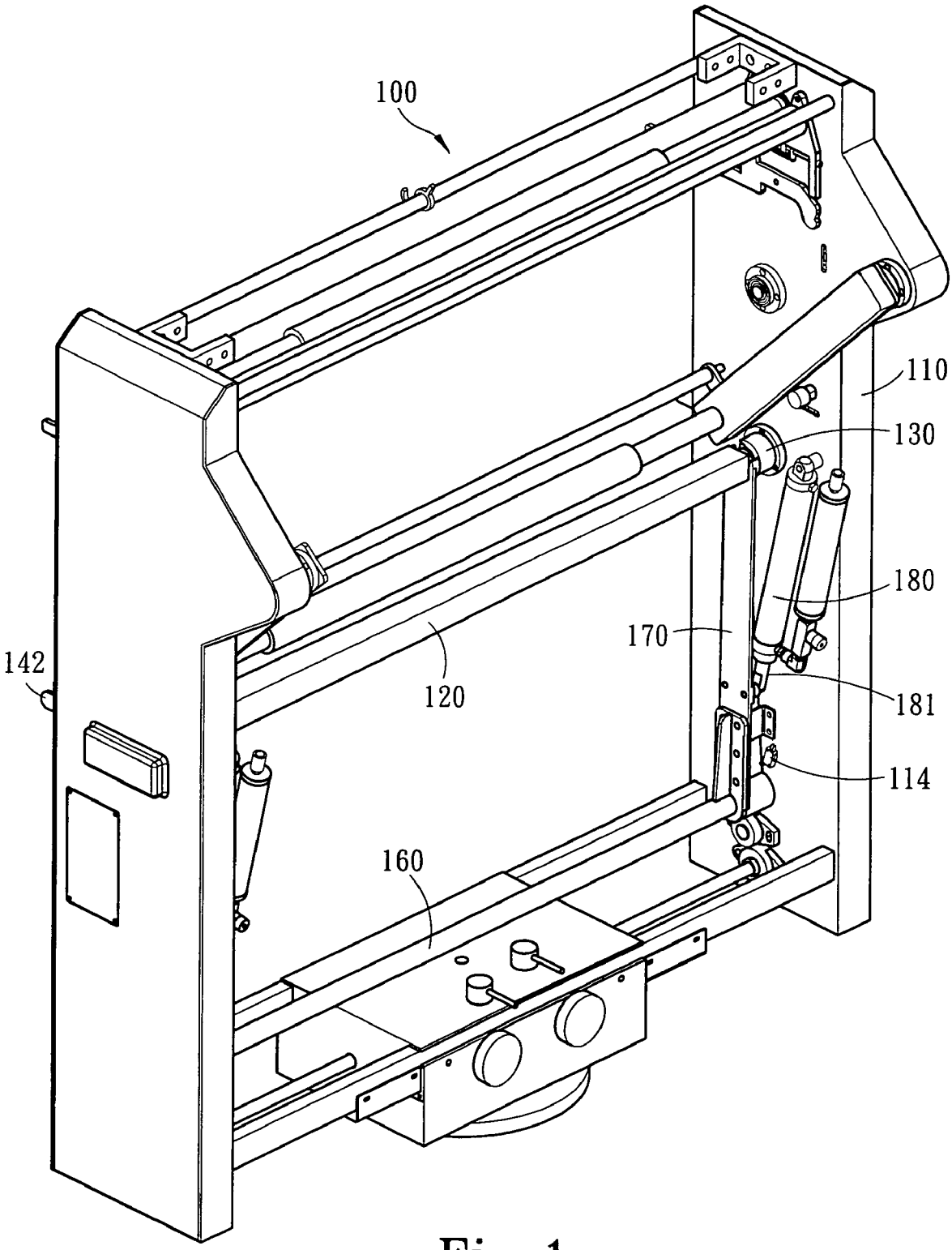
FIG. 1 is a perspective assembly diagram showing that the doffing apparatus of the present invention is assembled to a high-speed high-stand fabric take-up device.
Figure 2:
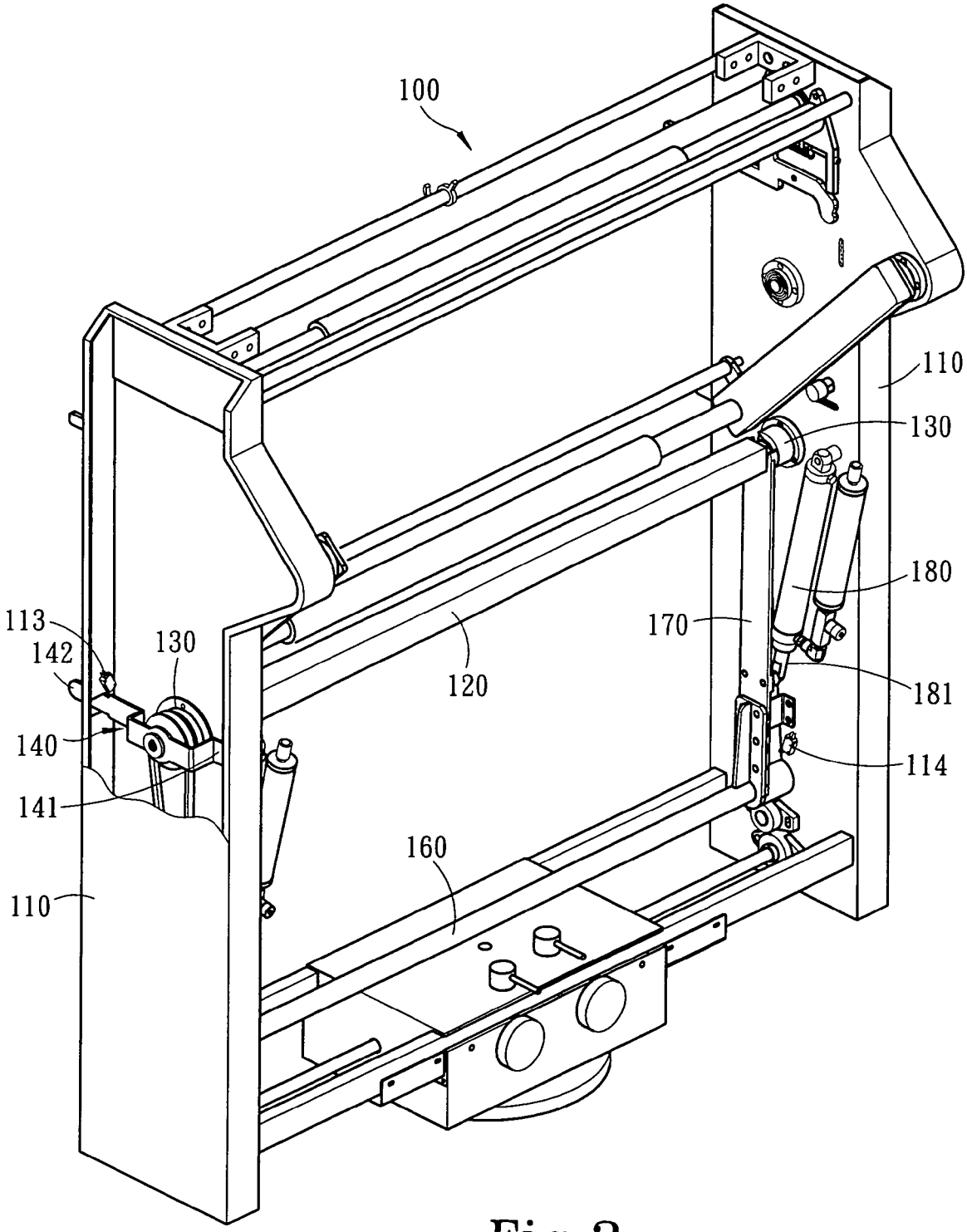
FIG. 2 is a perspective assembly diagram from the identical viewing angle of FIG. 1, wherein the coupling relationship between the drive wheel and the doffing apparatus inside the side-frame casing is particularly illustrated.
Figure 3:
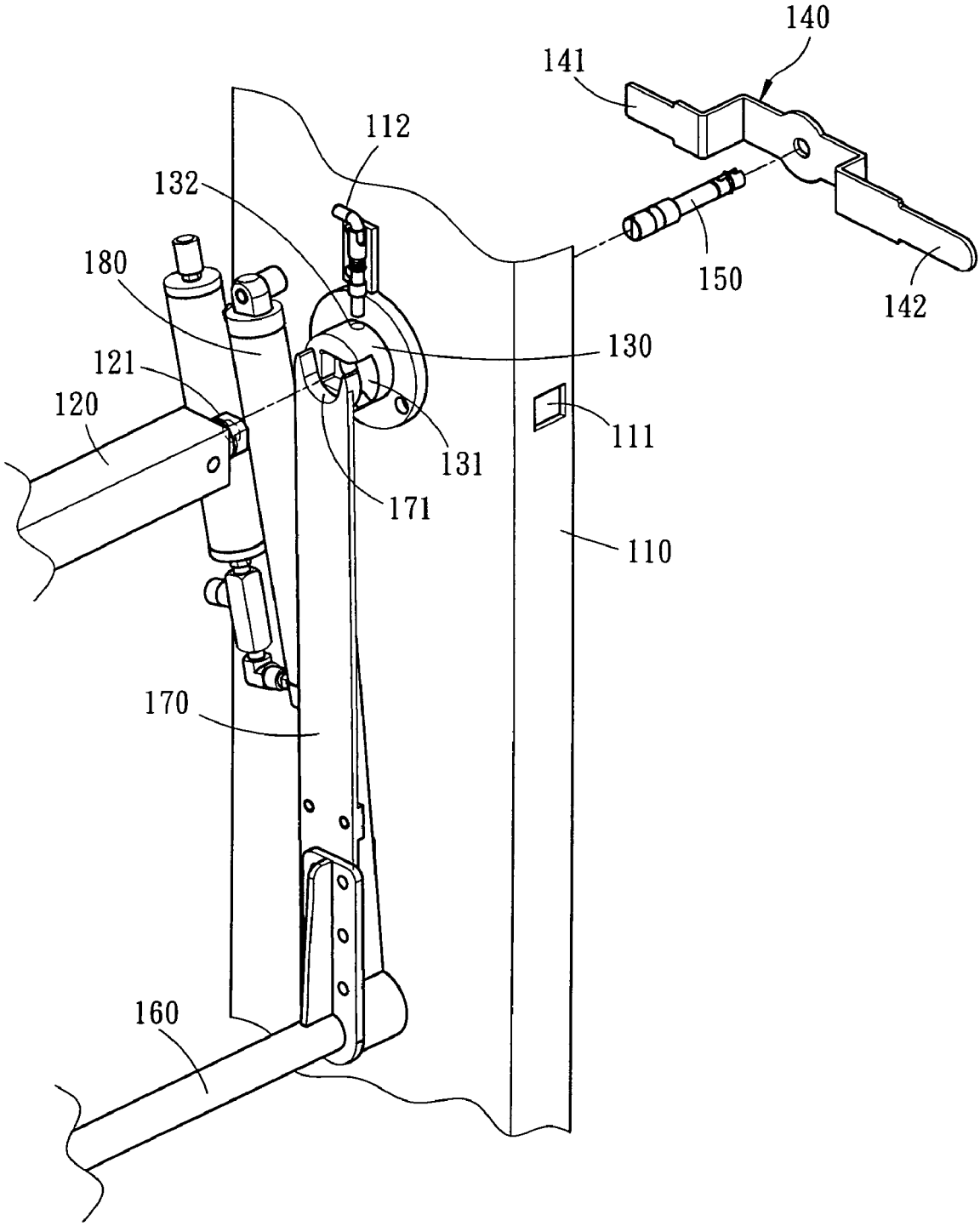
FIG. 3 is an exploded view showing a portion of elements of the doffing apparatus of the present invention.

Refer to FIG. 1, FIG. 2, and FIG. 3. The doffing apparatus of a high-speed high-stand fabric take-up device 100 is applicable to a fabric take-up device having a higher fabric-storage volume. In the current embodiment, the fabric take-up device 100 at least comprises: two side-frame casings 110 sitting opposite to each other, a fabric-winding rod 120, and two drive wheels 130. Two hollow rod shafts 121 separately project from each end of the fabric-winding rod 120. One side of the drive wheel 130 has a rabbet 131, and one end of the rabbet 131 extends to the perimeter of the drive wheel 130. The shape of the rod shaft 121 mates with the contour of the rabbet 131, and the shape of the rod shaft 121 is preferred to be rectangular. The rod shaft 121 can be engaged to the drive wheel 130 via the rabbet 131. The drive wheels 130 are linked to a transmission mechanism (not shown in the drawings) and drive the fabric-winding rod 120 to rotate between two side-frame casings 110 and wind fabric up.

The doffing apparatus comprises: a couple of control handles 140, a couple of safety pins 150, a rod 160, a couple of support brackets 170, and a couple of hydraulic cylinders 180. The couple of control handles 140 are separately installed on two side-frame casings 110. Each control handle 140 has a fixed end 141 and a movable end 142. The fixed end 141 is fixed to the interior of the side-frame casing 110, and the movable end 142 projects through an opening 111 of the side-frame casing 110 to the exterior of the side-frame casing 110. Each safety pin 150 penetrates the corresponding drive wheel 130. One end of the safety pin 150 is fixed to the control handle 140, and the other end of the safety pin 150 is normally inserted through the hollow rod shaft 121 and coupled to the fabric-winding rod 120. The rod 160 is pivotedly installed between two side-frame casings 110 and near the bottom of two side-frame casings 110. Each support bracket 170 is installed between the fabric-winding rod 120 and the rod 160. One end of the support bracket 170 is fixed to the rod 160, and the other end of the support bracket 170 has a longitudinal notch 171, which is used to support the fabric-winding rod 120 to span between two support brackets 170. The couple of hydraulic cylinders 180 are separately disposed in two side-frame casings 110. One end of the hydraulic cylinder 180 is pivotedly installed to the side-frame casing 110, and the other end of the hydraulic cylinder 180 has a cylinder shaft 181, which can move back and forth along the hydraulic cylinder 180, and the external end of the cylinder shaft 181 is pivotedly installed to the support bracket 170. As the safety pin 150 is normally inserted through the hollow rod shaft 121 of the fabric-winding rod 120, the connection between the drive wheel 130 and the rod shaft 121 of the fabric-winding rod 120 is thus enhanced. In other words, in addition to the engagement between the drive wheel 130 the rod shaft 121 via the rabbet 131, the design of the safety pins 150 further promotes the safety of fabric-winding operation via preventing the fabric-winding rod 120 separating from the drive wheel 130.

Refer to FIG. 3. Further, a movable positioning bolt 112 is installed on either of the side-frame casings 110 and near the drive wheel 130, and the drive wheel 130 has a positioning hole 132 on its perimeter. When the fabric-doffing operation is to be undertaken, the positioning bolt 112 is inserted into the positioning hole 132 lest the drive wheel 130 rotate once more, and the rabbet 131 of the drive wheel 130 can also be oriented to a transverse direction so that the rod shaft 121 of the fabric-winding rod 120 can be easily disengaged from the rabbet 131.

Figure 4A:
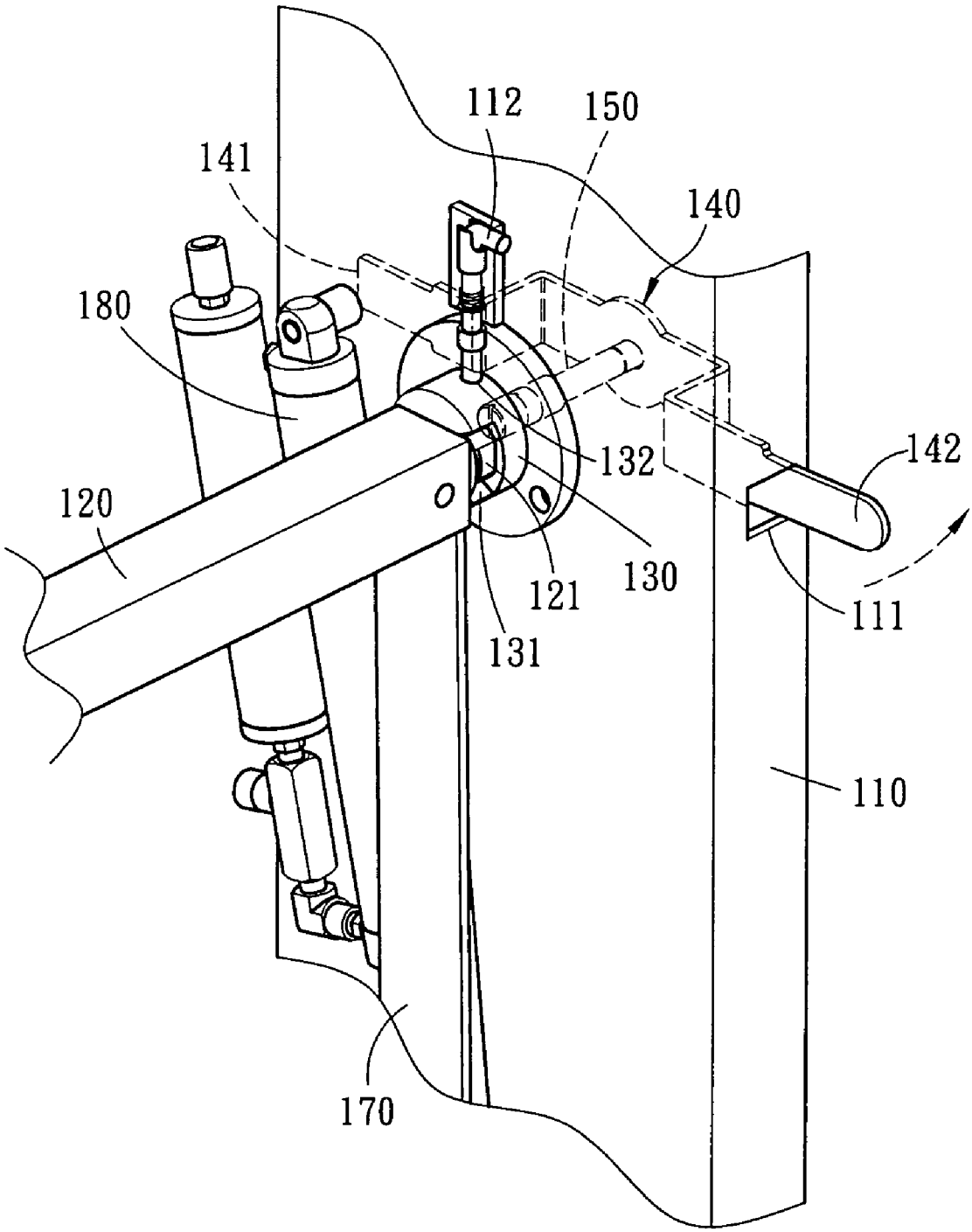
FIG. 4A to FIG. 4C show the procedures of the fabric-doffing operation via the doffing apparatus of the present invention.
Figure 4B:
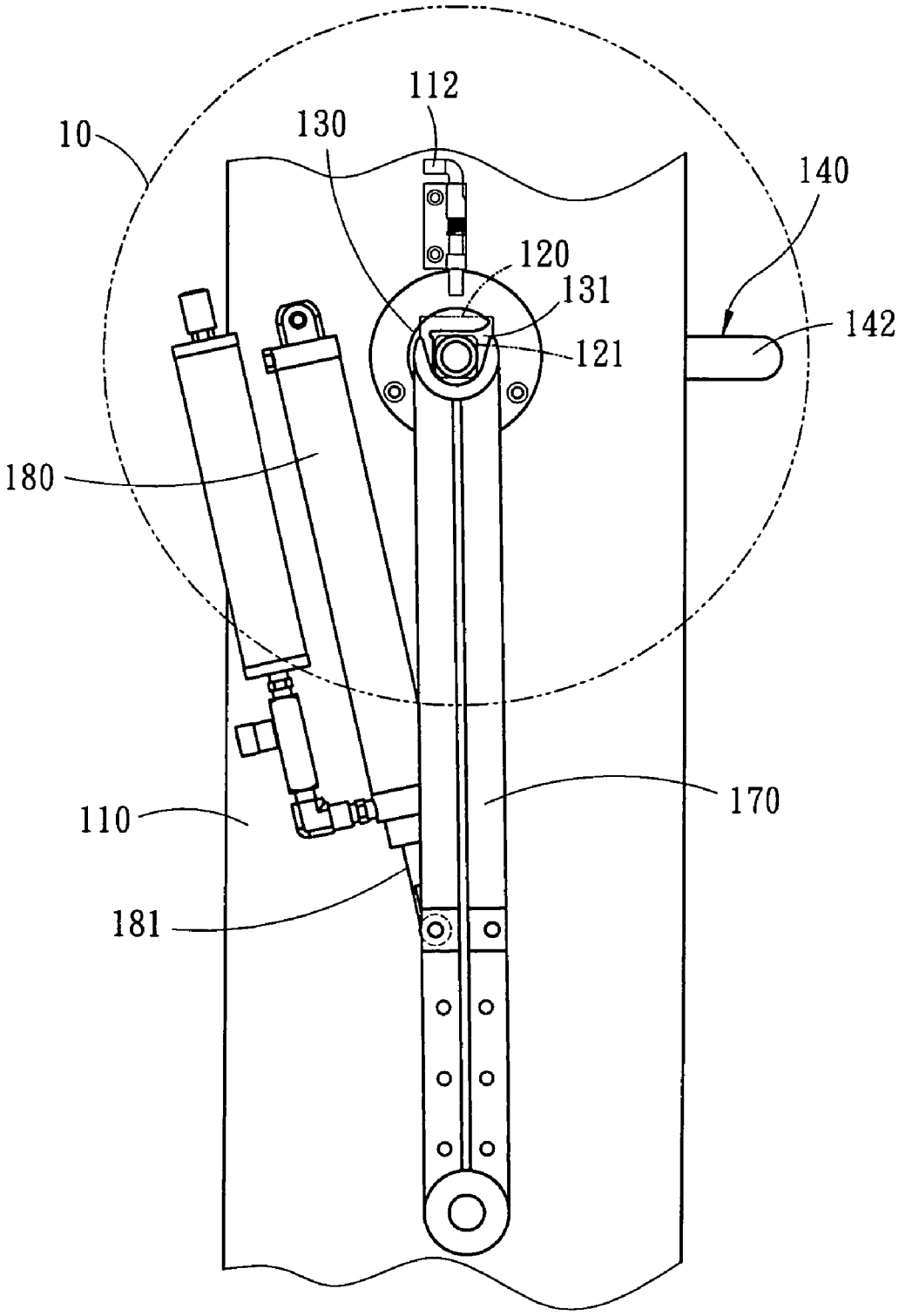
Figure 4C:
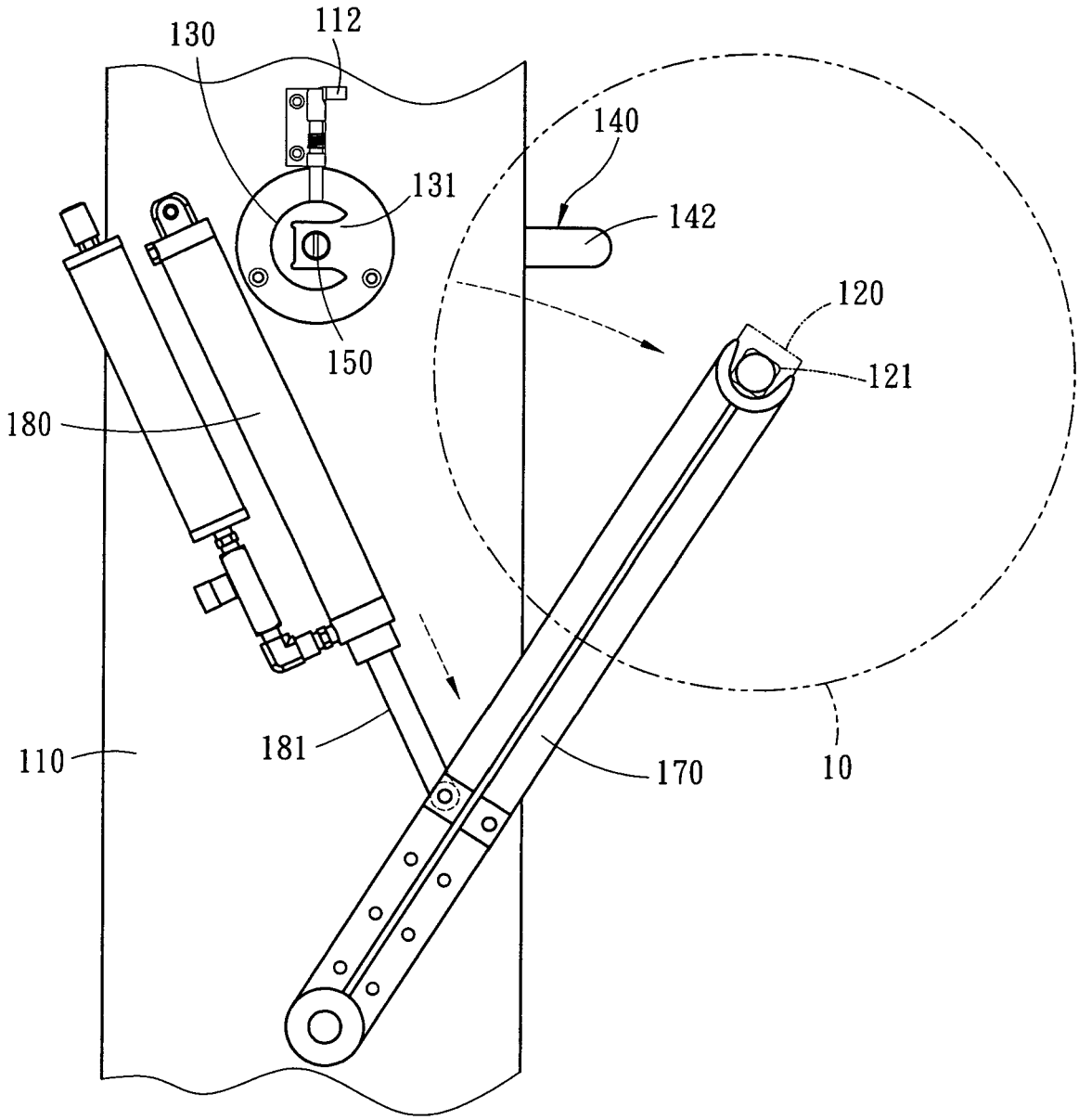

The fabric-doffing process is to be described below in detail. Refer to from FIG. 4A to FIG. 4C. As shown in FIG. 4A, when the fabric-doffing operation is to be undertaken, firstly, the positioning bolt 112 is inserted into the positioning hole 132 lest the drive wheel 130 rotate again and so that the rabbet 131 of the drive wheel 130 can also be oriented to a transverse direction. Next, the movable end 142 of the control handle 140 is shifted to draw the safety pin 150 away from the rod shaft 121 of the fabric-winding rod 120, also as shown in FIG. 4A. And next, the fabric-winding rod 120 is moved to enable the rod shafts 121 of the fabric-winding rod 120 to disengage from the rabbets 131 of the drive wheels 130. And then, the fabric-winding rod 120 sustained by the support brackets 170 moves downward along an arc path until it reaches an appropriate position where the fabric together with the fabric-winding rod 120 is doffed from the support brackets 170, as shown in FIG. 4B and FIG. 4C.

It is to be noted that when the support brackets 170 moves downward along the aforementioned arc path, the cylinder shafts 181 of the hydraulic cylinders 180 will gradually stretch out to buffer the descending speed of the support brackets 170 lest the fabric 10 together with the fabric-winding rod 120, whose weight is great, descend too fast and harm operators. Obviously, according to the spirit of the invention disclosed herein, the persons skilled in the art can modify the buffer force of the hydraulic cylinders 180 according to the weight of the fabric roll so that the descending speed of the support brackets 170 can be appropriately adjusted and the safety and convenience of fabric-doffing operation can be promoted.

In the current embodiment, as the descending speed of the support brackets 170 is buffered by the hydraulic cylinders 180, the fabric together with the fabric-winding rod 120 can be doffed by man and free from using a lifter. Thus, the special aisle for the lifter is no more needed in the factory, and the number of the fabric take-up devices 100 can be increased in order to promote productivity.

Refer to FIG. 2. Further, a first limit switch 113 can be installed inside one of the side-frame casings 110. When the fabric-winding operation is being undertaken, the first limit switch 113 keeps contacting the control handle 140. When the fabric-doffing operation is to be undertaken, the control handle 140 is separated from the limit switch 113 via shifting the movable end 142, which can automatically switch off the power of the fabric take-up device 100 lest the drive wheel 130 rotate mistakenly, so that the safety of the fabric-doffing operation is promoted.

Refer to FIG. 2 again. A second limit switch 114 can also be installed inside one of the side-frame casings 110. When the fabric-winding operation is being undertaken, the second limit switch 114 keeps contacting one of the support brackets 170. When the fabric-doffing operation is to be undertaken, the support bracket 170 is separated from the limit switch 114 via moving the fabric-winding rod 120, which can automatically switch off the power of the fabric take-up device 100, so that the safety of the fabric-doffing operation is promoted.

In summary, via the safety pins' enhancing the connection between the drive wheel and the rod shaft of the fabric-winding rod, the doffing apparatus of a high-speed high-stand fabric take-up device of the present invention can promote the safety of the fabric-doffing operation. Further, the connection and disconnection between the safety pins and the rod shafts of the fabric-winding rod is implemented just via shifting the control handle, so that the operation thereof is thus simple and quick. Furthermore, via the hydraulic cylinders' providing the buffer force to enable the support brackets to gradually rotate, the descending speed of the support brackets can be reduced, so that the safety of the fabric-doffing operation is promoted.

Those embodiments disclosed above are only to clarify the present invention but not to limit the scope of the present invention. Any equivalent modification and variation made by the persons skilled in the art is to be included within the scope of the present invention, and the scope of the present invention is to be dependent on the claims attached below.

What is claimed is:

1. A doffing apparatus of a high-speed high-stand fabric take-up device, applicable to a high-speed high-stand fabric take-up device, wherein said high-speed high-stand fabric take-up device comprises at least: two side-frame casings sitting opposite to each other, a fabric-winding rod, two drive wheels; each end of said fabric-winding rod protrudes a rod shaft; a rabbet is installed on one face of said drive wheel; said rabbet extends to the perimeter of said drive wheel; said rod shaft of said fabric-winding rod can be engaged to said drive wheel via said rabbet; said drive wheels drive said fabric-winding rod to rotate between two said side-frame casings and roll fabric up; and wherein said doffing apparatus comprises:

a couple of control handles, separately installed on two said side-frame casings, wherein each said control handle has a fixed end and a movable end; said fixed end is fixed to the interior of said side-frame casing, and said movable end projects through an opening of said side-frame casing to the exterior of said side-frame casing;

a couple of safety pins, separately penetrating said drive wheel corresponding thereto, wherein one end of said safety pin is fixed to said control handle, the relative position of said safety pin can be changed via shifting said movable end of said control handle;

a rod, pivotedly installed between two said side-frame casings;

a couple of support brackets, wherein one end of said support bracket is fixed to said rod, and the other end of said support bracket has a longitudinal notch, which is used to support said fabric-winding rod to span between two said support brackets; and a couple of hydraulic cylinders, separately disposed in two said side-frame casings, wherein one end of said hydraulic cylinder is pivotedly installed to said side-frame casing, and the other end of said hydraulic cylinder has a cylinder shaft, which can move back and forth along said hydraulic cylinder, and the external end of said cylinder shaft is pivotedly installed to said support bracket; and wherein via said safety pins' enhancing the connection between said drive wheel and said rod shaft of said fabric-winding rod, the safety of fabric-winding operation can be promoted; via said hydraulic cylinders providing a buffer force to decelerate the rotation speed of said support bracket, the safety of fabric-doffing operation can be promoted.

2. The doffing apparatus of a high-speed high-stand fabric take-up device according to claim 1, further comprising a positioning bolt movably installed to either said side-frame casing, wherein said drive wheel has a positioning hole; when a fabric-doffing operation is to be undertaken, via inserting said positioning bolt into said positioning hole, said rabbet of said drive wheel is oriented to a transverse direction lest said drive wheel rotate again and so that said rod shaft of said fabric-winding rod can be easily disengaged from said rabbet.

3. The doffing apparatus of a high-speed high-stand fabric take-up device according to claim 1, further comprising a first limit switch disposed inside either said side-frame casing, wherein when a fabric-winding operation is being undertaken, said first limit switch keeps contacting said control handle; when a fabric-doffing operation is to be undertaken, via shifting said movable end of said control handle, said control handle is separated from said first limit switch, and the power is automatically switched off thereby so that the safety of said fabric-doffing operation can be promoted.

4. The doffing apparatus of a high-speed high-stand fabric take-up device according to claim 1, further comprising a second limit switch disposed inside either said side-frame casing, wherein when a fabric-winding operation is being undertaken, said second limit switch keeps contacting one of said support brackets; when a fabric-doffing operation is to be undertaken, via moving said fabric-winding rod, said fabric-winding rod is separated from said second limit switch, and the power is automatically switched off so that the safety of said fabric-doffing operation can be promoted.

* * * * *